United States Patent [19]

Peake

[11] Patent Number: 4,799,411

[45] Date of Patent: Jan. 24, 1989

[54] RELATING TO THE REPETITIVE CUTTING OF WORKPIECE BLANKS

[75] Inventor: Roy P. Peake, Northants, England

[73] Assignee: Cox & Wright Limited, Rushden, England

[21] Appl. No.: 47,585

[22] Filed: May 7, 1987

Related U.S. Application Data

[63] Continuation of Ser. No. 774,356, Sep. 10, 1985, abandoned.

[30] Foreign Application Priority Data

Sep. 11, 1984 [GB] United Kingdom ..... 8422938
Oct. 16, 1984 [GB] United Kingdom ..... 8426116

[51] Int. Cl.[4] ..... B26D 3/00
[52] U.S. Cl. ..... 83/50; 83/216
[58] Field of Search ..... 83/50, 49, 216, 534, 83/556, 559, 560; 493/62, 61, 74, 372

[56] References Cited

U.S. PATENT DOCUMENTS

| | | | |
|---|---|---|---|
| 1,439,393 | 12/1922 | Assmann, Jr. | 83/50 |
| 1,493,010 | 5/1924 | Winkley . | |
| 2,352,118 | 6/1944 | Poupitch | 83/49 X |
| 3,589,221 | 6/1971 | Deegan | 83/41 |
| 4,241,632 | 12/1980 | Seo | 83/560 |
| 4,283,976 | 8/1981 | Wennerstrom | 83/341 X |
| 4,369,684 | 1/1983 | Perman et al. | 83/216 |
| 4,555,967 | 12/1985 | Jumel | 83/216 X |

FOREIGN PATENT DOCUMENTS

| | | | |
|---|---|---|---|
| 191333 | 1/1907 | Fed. Rep. of Germany . | |
| 1456578 | 10/1966 | France . | |
| 2165209 | 7/1973 | France | 83/50 |
| 0159788 | 12/1979 | Japan | 83/50 |
| 153658 | 2/1978 | United Kingdom . | |
| 1501514 | 2/1978 | United Kingdom . | |

*Primary Examiner*—James F. Coan
*Attorney, Agent, or Firm*—Hall, Myers & Rose

[57] ABSTRACT

The invention provides a method of working with a travelling head press to cut rows of identical workpieces across wide sheet material. The combination of the press and the means feeding the sheet material through it is so arranged that rows of workpieces can be cut on the bias along transverse lines at an angle other than a rightangle to the direction of feed of the material, for best utilization of the material, and this bias angle can be changed to suit different workpiece shapes and different cutting tools without reorientation of the press base. In one embodiment a press is used which is constructed to swivel on its base; and in another embodiment the sheet material is fed forward by the feeding means by equal incremental amounts between successive cutting strokes during the cutting of a row of workpieces.

10 Claims, 3 Drawing Sheets

RELATING TO THE REPETITIVE CUTTING OF WORKPIECE BLANKS

Figure 1:
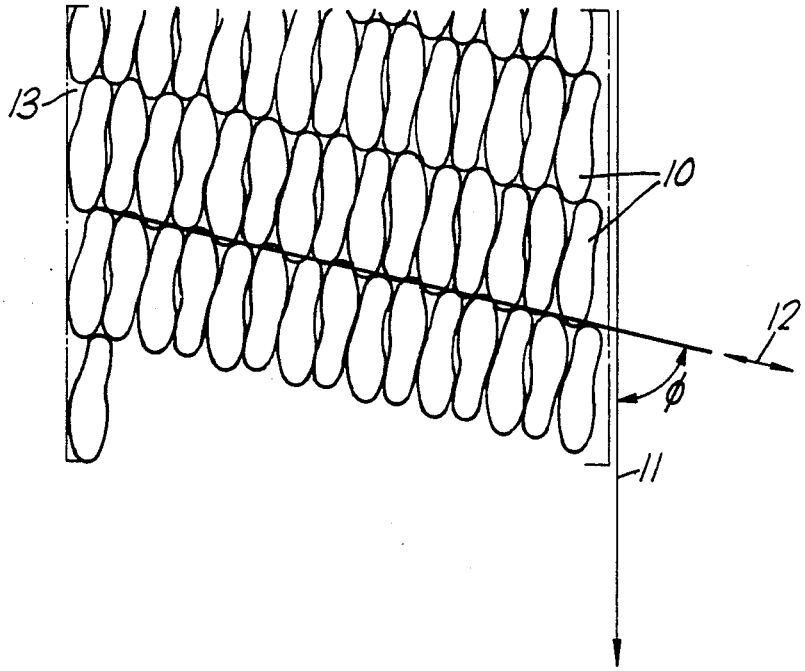

This is a continuation of application Ser. No. 774,356, filed Sept. 10, 1985, and now abandoned.

This invention relates to the repetitive cutting of large numbers of identical workpiece blanks or shapes from wide sheet or roll materials by means of travelling head presses. Such presses have a press bed that is wide in the direction transverse to the direction of feed of the stock material to be cut through the press, to accommodate the wide material, and a press head carrying a cutting knife profiled to cut blanks of the desired shape travels to and fro stepwise along an overhead beam of the press in a direction transverse to the direction of feed, with a vertical cutting stroke being performed at each position of dwell of the press head, the object being to cut as many of the workpiece shapes from a lateral strip of the stock material as can be fitted into its width so that there is as little waste material as possible.

Conventionally, the press is disposed so that the direction of stepwise travel of the press head is at rightangles to the direction of feed of the stock material through the press. However, depending on the particular shape of the workpiece blanks or components to be cut, cutting a succession of them along a strip of the stock material at rightangles to the direction of its length may not necessarily result in the most economical use of the stock material. Cutting "on the bias", that is to say with the press head travelling across the stock material along a path that is at some angle other than a rightangle to the direction of length of the stock, can often result in less waste, and it is known to operate with the press standing obliquely so that a predetermined slant angle is obtained between the stock feed direction and the direction of press head travel.

The problem of cutting "on the bias" to minimise waste is that the best slant angle at which to set the press is different for different workpiece shapes and cannot usually be determined from an inspection of the shape, and furthermore once a press has been installed to work at one slant angle it is a major operation, involving heavy lifting gear and re-installation, to change the slant angle. It is therefore an object of the invention to tackle this problem.

According to the present invention, the method of working comprises the steps of:

(i) providing a combination of a travelling head press and sheet material feeding means that is arranged for the cutting of rows of workpiece shapes from the sheet material at a variable bias angle and which is adjustable to change the bias angle without reorientation of the press base, (ii) selecting and fitting to the press, a particular cutting tool for the stepwise cutting of a succession of desired workpiece shapes in a row across the width of the material, (iii) computing the best bias angle for the particular workpiece shapes to be cut by the cutting tool selected, and (iv) adjusting the press and sheet feeding means combination to set it for working at that bias angle.

In one embodiment, the method comprises the steps of:

(i) providing a travelling head press that can swivel on its base in the horizontal plane relatively to the sheet material feeding means, (ii) selecting and fitting to the press a particular cutting tool for the stepwise cutting of desired workpiece shapes in a row across the width of the material, (iii) computing the best slant angle for the particular workpiece shapes to be cut by the cutting tool selected, and (iv) swivelling the press to set it at that slant angle relatively to the feeding means.

In another embodiment, the press performs successive cutting strokes at a succession of positions across the width of the sheet material that lie along a line at rightangles to the direction of feed of the sheet material by the feeding means, in order to cut a row of workpiece shapes across the sheet material, and the sheet material feeding means is automatically stepped forward in the feed direction between successive cutting strokes by equal incremental amounts such as to produce a row of workpiece shapes at the computed bias angle.

Figure 2:
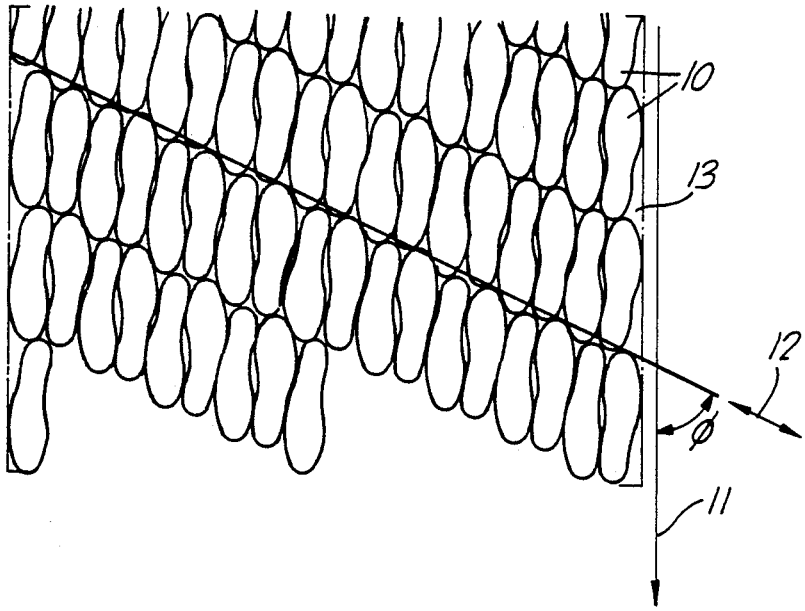
Figure 3:
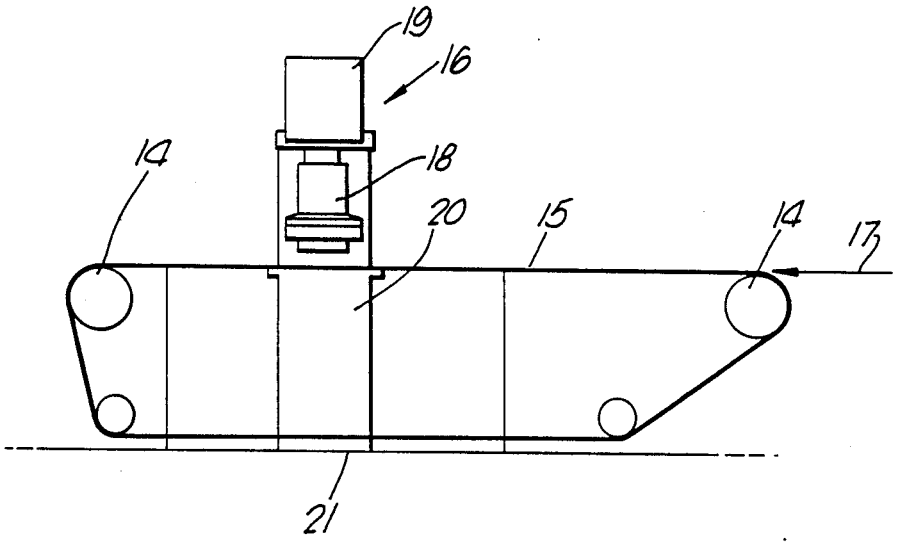
Figure 6:
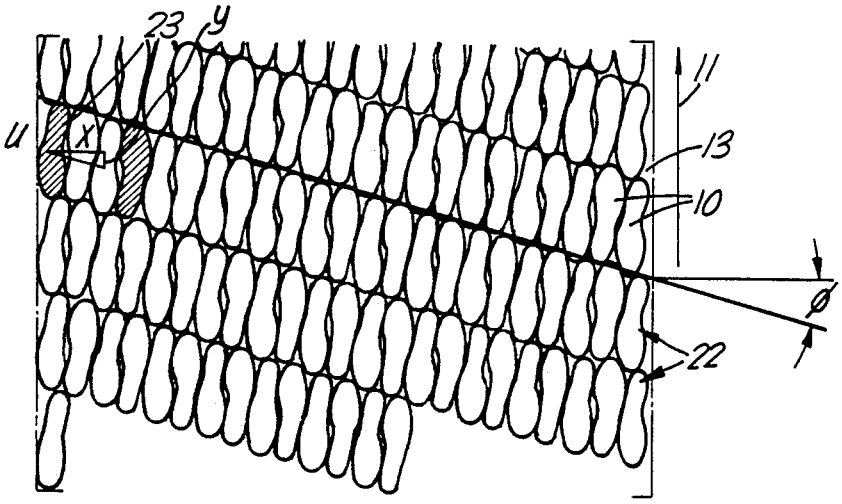
Figure 4:
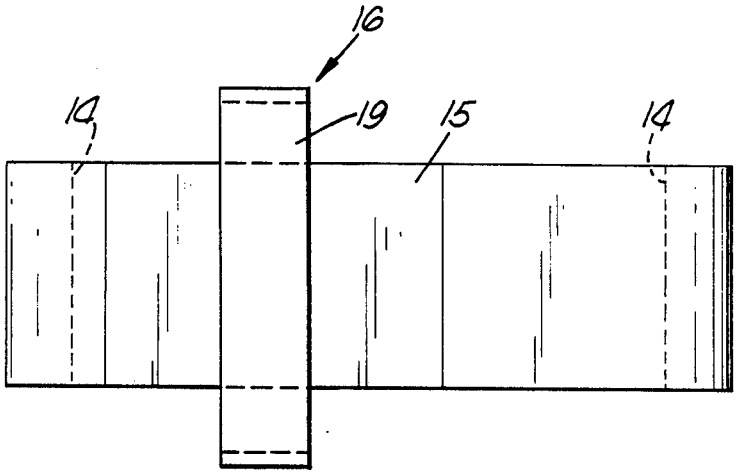
Figure 5:
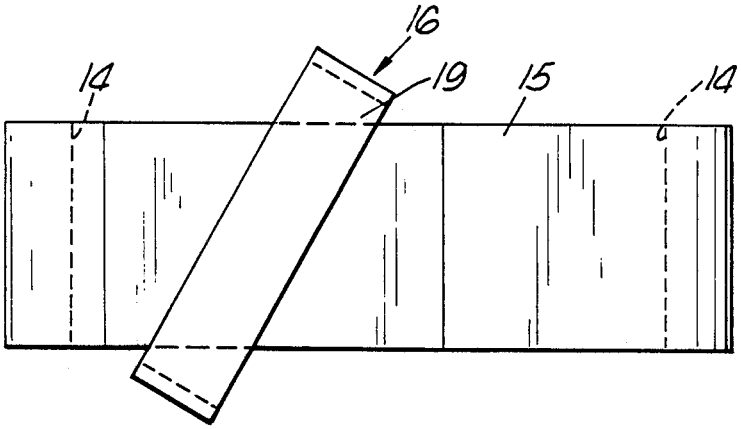

Arrangements for performing the invention will now be described by way of example with reference to the accompanying diagrammatic drawings, in which:

FIGS. 1 and 2 are diagrams illustrating the cutting of rows of identical workpiece shapes on the bias, FIGS. 3 and 4 are, respectively, a diagrammatic side elevation and a diagrammatic plan of a travelling head press and sheet material feeding means, FIG. 5 is a diagrammatic plan showing the press swivelled to cut on the bias, and FIG. 6 is a further diagram of rows of workpiece shapes illustrating another method of working.

FIGS. 1 and 2 show computer plans for cutting the same shoe component shape 10 at two different slant angles from two different widths of stock material 13. In each case, the arrow 11 indicates the direction of travel of the stock and the arrows 12 the direction of slant travel of the press head. The angle $\phi$ is the variable slant angle.

In FIG. 1, the width of the stock material 13 is 1.25 meters and the workpiece shapes 10 are cut in fifteen rows across the width. The predicted utilisation of the stock material is 78%. In FIG. 2, the stock material width is 1.43 meters and the workpiece shapes are in eighteen rows across the width; the angle $\phi$, between the direction of press head travel and the direction of stock feed is less than in FIG. 1. In this case the predicted utilisation of the stock is 80.15%. Both cases give a higher stock utilisation than the case in which the press head travel is at right angles to the direction of stock feed.

A typical improvement in stock utilisation, by changing the direction of press head travel, from being at rightangles to the stock feed direction to the optimum slant angle, would be 4.25%. In high volume production, this represents a very considerable annual saving.

FIGS. 3, 4 and 5 are a diagrammatic elevation and two diagrammatic plans of a swivelling automatic travelling head press. The stock material transport 14 moves the feedstock 15 through the press 16 in the direction of the arrow 17. The press head 18 travels to and fro in a direction transverse to the direction of feed 17, along the press top beam 19. The press bed 20 is mounted to swivel in the horizontal plane on a base plate 21, carrying the top beam and the press head with it.

FIG. 4 shows the press set in the conventional manner with the direction of press head travel at rightangles to the direction of stock feed. FIG. 5 shows the press swivelled to a slant setting according to the predicted optimum angle determined by computer for the particular work to be performed by the particular cutting tool fitted. When the work changes the press can be rapidly swivelled to a new angle according to a fresh computer calculation for the new work.

The press will ordinarily have its own automatic control computer and the invention encompasses both using the computer of the press to determine the best slant angle for the work to be performed, possibly with setting of the angle by automatic swivelling of the press under computer control, and also calculation of the angle by a separate computer having no part in the operational control of the press.

The feed material from which the workpiece shapes are cut may be in any of the usual material forms used in such work, that is to say stock from a roll, or wide sheet material, or a lay-up of a number of superposed sheets.

FIG. 6 illustrates another method of achieving the desired result without swivelling the press. The diagram of FIG. 6 shows successive rows 22 of workpieces 10, in this case shoe components as before, cut "on the bias" from a sheet of stock material 12 travelling in the direction of arrow 11. The angle $\phi$ is the angle between the obliquely transverse direction of the rows 22 and a transverse line at rightangles to the direction of length and of feed of the material 13, and as before is calculated by computer, for the particular workpiece shape and cutting tool fitted, as being that angle at which optimum usage of the stock material will be achieved with least waste.

The travelling head press is installed in the usual way so that the press head and the cutting tool it carries traverse to and fro across the sheet material 13 in the direction at rightangles to the direction of material feed 11. As is usual, the press head traverses stepwise and a vertical cutting stoke is performed during each dwell period between succesive steps of movement. To cut on the bias, the feeding means for the sheet material 13, which may be a travelling belt, moving table or the like, is so controlled that it also feeds stepwise during the traverse of press head and cutting tool. That is to say, there is a dwell in the travel while the press head performs a vertical cutting strike but between one cutting stroke and the next the material 13 is inched forward by the amount necessary to create the angle $\phi$.

Although a single workpiece shape 10, may be cut at each cutting stroke of the press head and cutting tool, in the example illustrated the cutting knife is a double impression tool that cuts two shapes at a time, as indicated at 23. Therefore, the press head will travel during each step of its traverse a distance equal to twice the pitch distance of the workpiece shapes 10 in the direction at rightangles to the feed direction of the material 13, as indicated at X. The cutting knife is designed so that the two workpiece shapes cut in the same cutting stroke of the press head are staggered in the feed direction 11 by the amount necessary to achieve the angle $\phi$. The feed material 13 is itself fed forward in the direction 11 between successive cutting strokes of the press head by the amount Y, X and Y forming two sides of a rightangle triangle having $\phi$ as the angle of interest.

The desired bias angle is therefore obtained by appropriate selection of the incremental distance by which the material 13 is fed at each step in relation to the incremental distance by which the press head is traversed between successive cutting strikes, and whenever there is a change of cutting tool the angle $\phi$ can be changed as desired by changing this relationship. During travel of the press head in the reverse direction across the machine, the same procedure can be followed and another row cut; or the press head can make a full non-cutting return traverse right across the machine, the material 13 being meanwhile fed forward by a distance equal to the full pitch distance between the rows 22 of workpiece shapes in the direction of feed 11.

I claim:

1. A method of repetitive cutting of large numbers of identical workpiece shapes from wide sheet or roll material by means of a travelling head press, the method comprising the steps of:

(i) providing a combination of a travelling head press and sheet material feeding means that is arranged for the cutting of rows of workpiece shapes from the sheet material at a variable bias angle and which is adjustable to change the bias angle without reorientation of the press base, (ii) selecting and fitting to the press, a particular cutting tool for the stepwise cutting of a succession of desired workpiece shapes in a row across the entire width of the material, (iii) computing the best bias angle for the particular workpiece shapes to be cut by the cutting tool selected, (iv) adjusting the relative movements of the press and sheet feeding means such that the tool is moved along a fixed straight line at said bias angle relative to the sheet, and (v) cutting an entire row of workpiece shapes along said fixed straight line at said bias angle relative to said sheet material.

2. The method according to claim 1 further comprising the steps of advancing the workpice a predetermined distance between each cutting stroke of the cutting tool.

3. A method according to claim 1, wherein the press performs successive cutting strokes at a succession of positions across the width of the sheet material that lie along a line at rightangles to the direction of feed of the sheet material by the feeding means, in order to cut a row of workpice shapes across the sheet material, and the sheet material feeding means is automatically stepped forward in the feed direction between successive cutting strokes by equal incremental amounts such as to produce a row of workpiece shapes at the computed bias angle.

4. A method of repetitive cutting of large numbers of identical workpiece shapes from wide sheet or roll material by means of a travelling head press, the method comprising the steps of:

(i) providing a travelling head press that can swivel on its base in the horizontal plane relatively to the sheet material feeding means, (ii) computing the best slant angle for the particular workpiece shapes to be cut by the cutting tool selected.

(iii) swiveling the press relative to the base to set it at that slant angle relative to the feeding means, (iv) selecting and fitting to the press a particular cutting tool at a fixed location relative to the selected slant, and (v) cutting a row of workpiece shapes across the entire width of the sheet material along the line of the slant angle.

5. The method according to claim 4 further comprising the steps of:

feeding the sheet or roll material in only one direction and holding the sheet material in a fixed position during the cutting operation.

6. An apparatus for cutting rows of workpiece shapes from sheet material at a variable bias angle comprising:

a travelling head press having a base and a head which is swivelable over a large range of angles, relative to the sheet material and to said base, means for feeding sheet material to said head, and means for selectively computing and adjusting the bias angle between the direction of feed of the material and the cutting strokes of said head.

7. An apparatus according to claim 6 wherein said head is swivelable in the horizontal plane and said feeding means has a fixed position in the horizontal plane during each cutting stroke of said head.

8. A travelling head press comprising:

feeding means for conveying sheet material along a given path, a base for said press, a press bed and a press top beam having a fixed position relative to one another and rotatable over a large range of angles relative to the edge of said sheet material on said base to a predeterminable position relative to the path of travel of a workpiece, a cutting tool that makes successive cuts transverse to said sheet material at a selected bias angle between the direction of feed of the material and the cutting strokes of said head, a press head movable along and rotatable over a large range of angles relative to said shape material to a predeterminable position relative to said press top beam for each cutting tool selected, and means for securing a cutting tool in said press head.

9. The apparatus of claim 8 including control means for advancing the feeding means in the feed direction by equal incremental amounts between successive cutting strokes of the press head during the cutting of a row of workpieces thereby to produce a complete row of workpiece shapes at a computed bias angle across the entire width of the sheet material.

10. The travelling head press according to claim 5 wherein:

said control means holds the sheet material in a fixed position during the cutting operation.

* * * * *